US008388899B2

(12) United States Patent
Mitani et al.

(10) Patent No.: US 8,388,899 B2
(45) Date of Patent: Mar. 5, 2013

(54) EXHAUST GAS PURIFYING APPARATUS AND METHOD FOR MANUFACTURING EXHAUST GAS PURIFYING APPARATUS

(75) Inventors: Kenichi Mitani, Takahama (JP); Masayuki Eguchi, Takahama (JP); Tatsunari Yanagisawa, Takahama (JP)

(73) Assignee: Ibiden Co., Ltd., Ogaki-Shi (JP)

( * ) Notice: Subject to any disclaimer, the term of this patent is extended or adjusted under 35 U.S.C. 154(b) by 360 days.

(21) Appl. No.: 12/725,431

(22) Filed: Mar. 16, 2010

(65) Prior Publication Data

US 2010/0239468 A1 Sep. 23, 2010

(30) Foreign Application Priority Data

Mar. 23, 2009 (JP) ..... 2009-070768

(51) Int. Cl.
*B01D 50/00* (2006.01)

(52) U.S. Cl. ..... 422/179; 422/171

(58) Field of Classification Search ..... 422/168, 422/179; 205/705; 148/325
See application file for complete search history.

(56) References Cited

U.S. PATENT DOCUMENTS 3,921,273 A * 11/1975 Kondo et al. ..... 29/890
4,625,511 A 12/1986 Scheitlin et al.
5,792,285 A * 8/1998 Miyazaki et al. ..... 148/325
6,740,174 B2 * 5/2004 Miyazaki et al. ..... 148/325
2002/0127154 A1 * 9/2002 Foster et al. ..... 422/179
2003/0129102 A1 7/2003 Turek et al.
2006/0076247 A1 * 4/2006 Giordani et al. ..... 205/705
2006/0292340 A1 * 12/2006 Ohno et al. ..... 428/116

FOREIGN PATENT DOCUMENTS

EP 0602018 6/1994
EP 1736644 A1 * 12/2006
JP 2002-97945 4/2002
WO WO 2010/019642 2/2010

OTHER PUBLICATIONS

European Search Report for corresponding EP Application No. 10157019.0-2321, May 20, 2010, Europe.

* cited by examiner

*Primary Examiner* — Tom Duong
(74) *Attorney, Agent, or Firm* — Ditthavong Mori & Steiner, P.C.

(57) ABSTRACT

An exhaust gas purifying apparatus includes an exhaust gas treating body, a metal casing, and a holding sealing material. The exhaust gas treating body has a longitudinal direction and includes cell walls extending along the longitudinal direction to define cells between the cells. The metal casing has an inner surface and houses the exhaust gas treating body to face the inner surface. The holding sealing material is provided between the exhaust gas treating body and the inner surface of the metal casing to hold the exhaust gas treating body in the metal casing. The holding sealing material includes an inorganic fiber aggregated body. The metal casing has a corrosion area at least on a part of the inner surface. The corrosion area includes a corroded base material of the metal casing.

17 Claims, 9 Drawing Sheets

EXHAUST GAS PURIFYING APPARATUS AND METHOD FOR MANUFACTURING EXHAUST GAS PURIFYING APPARATUS

CROSS-REFERENCE TO RELATED APPLICATIONS

The present application claims priority under 35 U.S.C. §119 to Japanese Patent Application No. 2009-070768, filed on Mar. 23, 2009, the contents of which are incorporated herein by reference in their entirety.

BACKGROUND OF THE INVENTION

1. Field of the Invention

The present invention relates to an exhaust gas purifying apparatus and a method for manufacturing an exhaust gas purifying apparatus.

2. Discussion of the Background

Particulate matters (hereinafter, also referred to as PMs) are contained in exhaust gases discharged from internal combustion engines such as diesel engines, and in recent years, there has arisen a serious problem that these PMs are harmful to the environment and the human bodies. Moreover, since exhaust gases also contain toxic gas components such as CO, HC, and NOx, there have been growing concerns about influences of these toxic gas components on the environment and the human bodies.

In view of these, as an exhaust gas purifying apparatus for capturing PMs in exhaust gases and for purifying the toxic gas components, various exhaust gas purifying apparatuses have been proposed. Each of the exhaust gas purifying apparatuses is configured by: an exhaust gas treating body including a porous ceramic, such as silicon carbide and cordierite; a casing for housing the exhaust gas treating body; and a holding sealing material including an inorganic fiber aggregated body that is disposed between the exhaust gas treating body and the casing.

This holding sealing material is installed mainly for purposes of preventing the exhaust gas treating body from being damaged upon contact with the casing that covers its periphery because of vibrations and impacts caused by traveling or the like of an automobile and for preventing exhaust gases from leaking between the exhaust gas treating body and the casing.

Here, since the internal combustion engines are operated at an air fuel ratio close to the theoretical air fuel ratio for the purpose of improvement in fuel consumption, exhaust gases tend to increase their temperature and pressure. When exhaust gases having a high temperature and a high pressure reach the exhaust gas purifying apparatus, the difference of coefficient of thermal expansion between the exhaust gas treating body and the casing leads to variations of the interval therebetween. Therefore, the holding force of the holding sealing material that does not change the location of the holding sealing material even with some variations of the intervals is required.

In order to meet such demands, an expansive holding sealing material has been used. The expansive holding sealing material includes inorganic fibers and an expansive agent that is in a small size when the expansive holding sealing material is installed in a casing and expands by heating to a high temperature. The expansion of the expansive agent at a high temperature is used to improve the holding force of the holding sealing material.

However, the amount of the expansive agent in an expansive holding sealing material is limited because too-much expansive agents may collapse an exhaust gas treating body in the expansion. In addition, with an aim of overcoming the low holding force at a low temperature, it is necessary to apply heat to the holding sealing material in advance of the actual installation thereof to an exhaust gas purifying apparatus. Or alternatively, it is necessary to use a clamp in a metal casing to mechanically prevent a drop of a holding sealing material.

On the other hand, in an unexpansive holding sealing material including unexpansive inorganic fibers, the repulsive force of the inorganic fibers, which generates the holding force, is secured by increasing the weight per unit area of the holding sealing material. As a result, the pressure per unit area (hereinafter, also referred to as surface pressure), which is to be applied to the holding surface of the holding sealing material, is increased to improve the holding force of the holding sealing material.

However, in this method, since the holding sealing material is unexpansive, thermal expansion of a metal casing due to high-temperature exhaust gases may result in the lowered surface pressure of the holding sealing material, namely, the lowered holding force of the holding sealing material. In addition, increasing the weight per unit area of the holding sealing material in expectation of the thermal expansion of the metal casing requires a large amount of inorganic fibers, which is uneconomical. This tendency is more likely to be found in a large exhaust gas purifying apparatus for handling the exhaust gas treatment of a large internal combustion engine. Further, development of a holding sealing material which exerts the sufficient holding force in the minimal amount has also been demanded in economic standpoint.

With an aim of meeting the above demand, there has been proposed an exhaust gas purifying apparatus including a holding sealing material having a similar weight as the conventional one and an anti-drop mechanism for preventing a drop of the exhaust gas treating body in the metal casing, instead of increasing the weight per unit area of the holding sealing material.

As such an exhaust gas purifying apparatus, Japanese Patent Application Publication (KOKAI) No. 2002-97945 discloses a catalyst converter including a storage part in which a recessed bead is formed and a monolith type catalyst carrier is stored.

The contents of Japanese Patent Application Publication (KOKAI) No. 2002-97945 are incorporated herein by reference in their entirety.

SUMMARY OF THE INVENTION

According to one aspect of the present invention, an exhaust gas purifying apparatus includes an exhaust gas treating body, a metal casing, and a holding sealing material. The exhaust gas treating body has a longitudinal direction and includes cell walls extending along the longitudinal direction to define cells between the cells. The metal casing has an inner surface and houses the exhaust gas treating body to face the inner surface. The holding sealing material is provided between the exhaust gas treating body and the inner surface of the metal casing to hold the exhaust gas treating body in the metal casing. The holding sealing material includes an inorganic fiber aggregated body. The metal casing has a corrosion area at least on a part of the inner surface. The corrosion area includes a corroded base material of the metal casing.

According to another aspect of the present invention, a method for manufacturing an exhaust gas purifying apparatus includes winding a holding sealing material around an exhaust gas treating body to manufacture a wound body. The wound body is housed in a casing base. A corrosive agent is introduced into the holding sealing material from one or both ends of the holding sealing material to corrode an inner surface of the casing base.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1A:
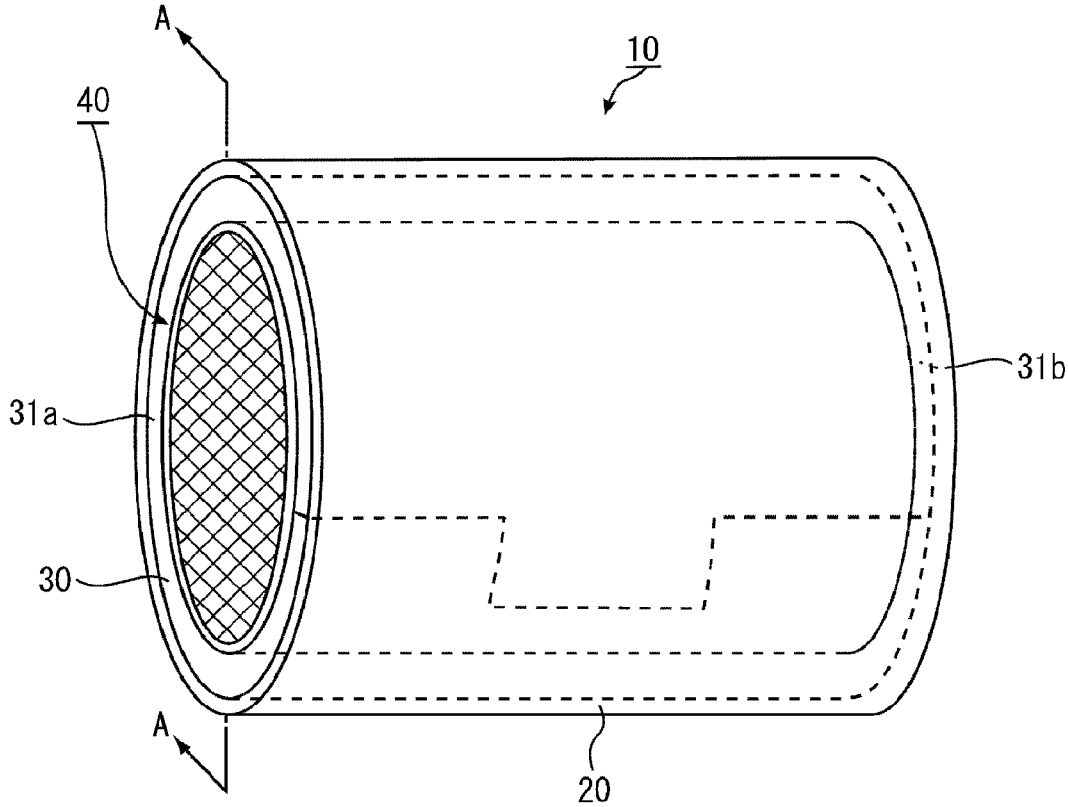
FIG. 1A is a perspective view schematically illustrating an exhaust gas purifying apparatus according to an embodiment of the present invention.

Japanese Patent Application Publication (KOKAI) No. 2002-97945 employs the following method as a method for forming beads. A cylindroid catalyst carrier wound with a buffer is inserted into a predetermined position in the center portion of an outer cylinder. Then, the center portion of the outer cylinder housing the catalyst carrier is pressed with a roller along the elliptical outer circumference, so that a recessed bead shallower than the thickness of the buffer is formed. The bead formed as above projects inwardly into the storage part so as to press the entire periphery of the catalyst carrier with the buffer interposed therebetween to fix the catalyst carrier.

However, in the method for fixing the catalyst carrier disclosed in Japanese Patent Application Publication (KOKAI) No. 2002-97945, adjustment of the shape and position of a pressing jig and control of the pressing force are required so that the recess depth of the recessed bead is surely shallower than the thickness of the buffer. This is for preventing damage in the catalyst carrier. Accordingly, it is necessary to change the pressing jig in accordance with the shape of the storage part storing the catalyst carrier and to prepare another jig for moving the pressing jig along the elliptical outer circumference of the outer cylinder. As a result, manufacture of a catalyst converter costs more and the procedure of the manufacture becomes more complicated.

Further, according to the fixing method disclosed in Japanese Patent Application Publication (KOKAI) No. 2002-97945, a bite of the bead projecting inwardly into the buffer fixes the catalyst carrier. Here, the buffer is placed between the storage part and the catalyst carrier and has been compressed to some extent. Accordingly, an excessive external force (pressure) is applied to the buffer. Then, the excessive external force is also applied to an inorganic fiber aggregated body forming the buffer, which may cause damage such as fracture of inorganic fibers by the external force in the portion where the bead is formed. Damage in the inorganic fibers loses the repulsive force of the inorganic fibers thereafter. Because of this, when the storage part is thermally expanded, the buffer can no longer keep the holding force as same as that before the thermal expansion thereof, resulting in a displacement or drop of the catalyst carrier.

The present inventors have intensively studied to find out that a displacement or drop of the exhaust gas treating body may be caused by a displacement of the holding sealing material from the metal casing. Based on this finding, the present inventors have found that an artificial corrosion in the inner surface of the metal casing is likely to increase abrasion resistance between the corroded inner surface and the holding sealing material. This allows the exhaust gas treating body be more easily held and fixed firmly without an operation of increasing the bulk density of the holding sealing material after its assembly.

The exhaust gas purifying apparatus of an embodiment of the present invention includes: an exhaust gas treating body in which a large number of cells are longitudinally disposed in parallel with one another with a cell wall interposed therebetween; a metal casing housing the exhaust gas treating body; and a holding sealing material provided between the exhaust gas treating body and the metal casing to hold the exhaust gas treating body, the holding sealing material including an inorganic fiber aggregated body, wherein the metal casing has a corrosion area at least on a part of an opposite surface that is included in an inner surface of the metal casing and is facing to the holding sealing material, the corrosion area being formed by a corroded base material of the metal casing.

In the exhaust gas purifying apparatus according to the embodiment of the present invention, the corrosion area is present in which the base material is corroded in a part of the inner surface of the metal casing (opposite surface). Therefore, random irregularities (e.g. simple recessed and projected shapes, burr shape, substantially spike-mound shape, and the like) tend to be formed on a part of the inner surface (opposite surface).

Then, such a corrosion area and the inorganic fibers forming the holding sealing material are more likely to be entangled to each other. As a result, the abrasion resistance between the holding sealing material and the metal casing tends to be greatly increased.

Here, the displacement of the holding sealing material that holds the exhaust gas treating body is more likely to be prevented in the metal casing without an operation of increasing the bulk density of the holding sealing material after its assembly so that the displacement or drop of the exhaust gas treating body is more likely to be prevented.

In addition, the abrasion resistance between the metal casing and the holding sealing material is generated as long as the holding sealing material and the metal casing are in contact with each other. Even the metal casing is thermally expanded by high-temperature exhaust gases, the contact between the metal casing and the holding sealing material is kept because the holding sealing material does not lose its repulsive force at all at that time.

Accordingly, the abrasion resistance is generated between the metal casing and the holding sealing material even when the metal casing is thermally expanded. Therefore, the exhaust gas purifying apparatus according to the embodiment of the present invention is more likely to hold and fix the exhaust gas treating body firmly, and the displacement or drop of the exhaust gas treating body is more likely to be prevented.

In the exhaust gas purifying apparatus according to the embodiment of the present invention, the corrosion area is desirably formed by a corrosive agent. Artificial corrosion of the inner surface of the metal casing with use of the corrosive agent more easily controls the range of the corrosion area as appropriate so that the abrasion resistance between the metal casing and the holding sealing material is more easily adjusted to the degree enough for holding and fixing the exhaust gas treating body.

Further, the corrosion area is formed by a simple method of contacting the metal casing with a corrosive agent. Accordingly, an expensive device or a complicated procedure is less likely to be needed in manufacturing the exhaust gas purifying apparatus. As a result, the exhaust gas purifying apparatus is more likely to be easily manufactured.

In the exhaust gas purifying apparatus according to the embodiment of the present invention, the corrosion area desirably covers a substantially entire inner circumference of the inner surface and is in a range from about 10% to about 70% of a total length of the inner surface from one end to the other end in the longitudinal direction of the metal casing. The corrosion area formed in the above range is more likely to secure the sufficient abrasion resistance for fixing the exhaust gas treating body between the metal casing and the holding sealing material.

Since the required abrasion resistance varies in accordance with the size of the used exhaust gas treating body and the like in the conventional exhaust gas purifying apparatus, the thickness of the holding sealing material or the degree of the bite of the metal casing onto the holding sealing material is required to be changed. However, in the exhaust gas purifying apparatus according to the embodiment of the present invention, the degree of the abrasion resistance is changed simply by changing the range of the corrosion area. Consequently, a special jig corresponding to each size of the exhaust gas treating body is less likely to be needed so that the exhaust gas purifying apparatus is more likely to be manufactured easily and efficiently.

The method for manufacturing an exhaust gas purifying apparatus according to the embodiment of the present invention includes: winding a holding sealing material around an exhaust gas treating body to manufacture a wound body; housing the wound body in a casing base; and introducing a corrosive agent into the holding sealing material from one or both ends of the holding sealing material to corrode an inner surface of the casing base.

In the method for manufacturing an exhaust gas purifying apparatus according to the embodiment of the present invention, a simple method is employed as a procedure for forming the corrosion area in the inner surface of the casing base. The simple method includes: housing the exhaust gas treating body in the casing base by interposing the holding sealing material therebetween; and introducing a corrosive agent from the end portion of the holding sealing material. Accordingly, the exhaust gas purifying apparatus according to the embodiment of the present invention, in which the corrosion area is formed in the inner surface of the metal casing, is more likely to be manufactured easily and efficiently.

In addition, change of the kind and the amount of the corrosive agent more easily controls the corrosion mass and the size of the corrosion area to the desired value. Therefore, even when the abrasion resistance required in actual use needs to be changed due to the modifications in the size of the exhaust gas treating body and the like, preparation of a special jig or a significant change in the procedure is not needed. Accordingly, the exhaust gas treating body is more easily manufactured.

In the method for manufacturing an exhaust gas purifying apparatus according to the embodiment of the present invention, a corrosive agent to be used is desirably at least one of an acid solution, an oxidant solution, and a chloride solution. Since the corrosive agent exerts great corrosive action in the metal casing, the required corrosion mass is more easily obtained as well as the satisfactory decrease in the used amount of the corrosive agent and the corrosion time. In addition, when the above-listed corrosive agents are used, the safe operation is more easily secured.

In the method for manufacturing an exhaust gas purifying apparatus according to the embodiment of the present invention, an acid in the acid solution is desirably at least one of hydrochloric acid, nitric acid, sulfuric acid, phosphoric acid, hydrofluoric acid, sulfonic acid, acetic acid, formic acid, carbonic acid, and boric acid.

In the method for manufacturing an exhaust gas purifying apparatus according to the embodiment of the present invention, an oxidant in the oxidant solution is desirably at least one of peroxy acid, hydrogen peroxide, permanganic acid, perchloric acid, hypochlorous acid, and their salts.

In the method for manufacturing an exhaust gas purifying apparatus according to the embodiment of the present invention, a chloride in the chloride solution may be at least one of chlorides of lithium, sodium, potassium, rubidium, caesium, beryllium, magnesium, calcium, strontium, barium, and radium.

In the method for manufacturing an exhaust gas purifying apparatus according to the embodiment of the present invention, the corrosive agent is an oxidant solution or a chloride solution. When the exhaust gas purifying apparatus is heated by exhaust gases and the like after the corrosion of the casing base by the acid solution, the acid component in the acid solution may be gasified. Such gasification does not cause any problem in use of the exhaust gas purifying apparatus because the amount of the generated gas is quite small. However, the oxidant solution or chloride solution only generates decomposed material of the components of the solution (e.g. water from hydrogen peroxide, sodium chloride from chloride, and the like), and therefore, the oxidant solution or chloride solution is suitably used from the viewpoint of the environmental safety.

The method for manufacturing an exhaust gas purifying apparatus according to the embodiment of the present invention includes the drying process of the holding sealing material after the corrosion process. This process tends to allow an immediate operation of the next process (e.g. finishing, inspection, assembling to auto body, and the like) so that manufacture efficiency of the exhaust gas purifying apparatus is more likely to be enhanced.

First Embodiment

Hereinafter, a description is given with reference to the drawings on a first embodiment which is one embodiment of the exhaust gas purifying apparatus and the method for manufacturing an exhaust gas purifying apparatus according to the embodiments of the present invention.

Figure 1B:
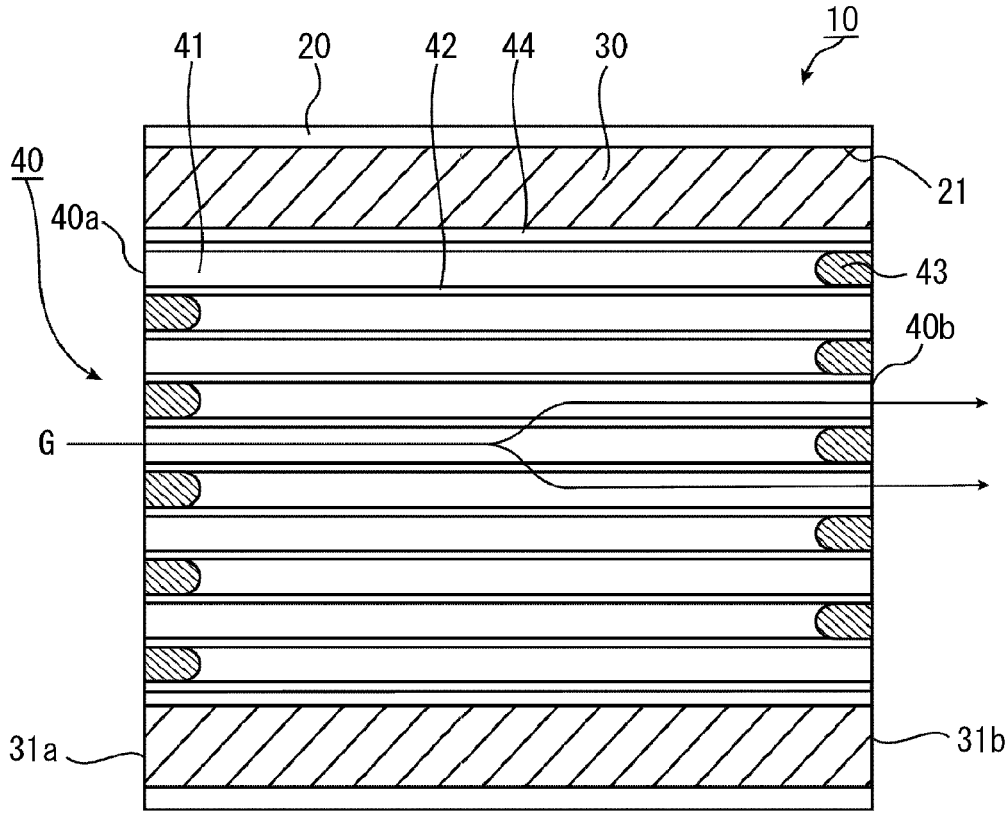
FIG. 1B is an A-A line cross-sectional view of the exhaust gas purifying apparatus illustrated in FIG. 1A.

FIG. 1A is a perspective view schematically illustrating an exhaust gas purifying apparatus of the present embodiment, and FIG. 1B is an A-A line cross-sectional view of the exhaust gas purifying apparatus illustrated in FIG. 1A.

As illustrated in FIG. 1A and FIG. 1B, an exhaust gas purifying apparatus 10 includes: a pillar-shaped exhaust gas treating body 40 in which a large number of cells 41 are longitudinally disposed in parallel with one another with a cell wall 42 interposed therebetween; a metal casing 20 housing the exhaust gas treating body 40; and a holding sealing material 30 provided between the exhaust gas treating body 40 and the metal casing 20 and configured to hold the exhaust gas treating body 40.

The metal casing 20 has an opposite surface 21 facing to the holding sealing material 30 and including a corrosion area in which a base material of the metal casing 20 is corroded. The opposite surface 21 refers to the surface facing to the holding sealing material 30 in the inner surface of the metal casing 20. In the exhaust gas purifying apparatus 10 illustrated in FIG. 1, the lengths of the metal casing 20 in its longitudinal direction and of the holding sealing material 30 in its latitudinal direction are substantially the same, and therefore, the opposite surface 21 corresponds to the whole inner surface of the metal casing 20. The corrosion area will be specifically described later. If needed, to the end portions of the metal casing 20 are connected: an introducing pipe configured to introduce exhaust gases discharged from internal combustion engines; and an exhaust pipe with which the exhaust gases that have passed through an exhaust gas purifying apparatus 10 are discharged to the outside.

In the exhaust gas purifying apparatus 10 of the present embodiment, as illustrated in FIG. 1B, a honeycomb filter is employed in which either one end of each of the cells is sealed with a plug 43 is used as the exhaust gas treating body 40.

The following will discuss the case where exhaust gases pass through the exhaust gas purifying apparatus 10 having the above-mentioned configuration with reference to FIG. 1B.

As illustrated in FIG. 1B, the exhaust gas (in FIG. 1B, the exhaust gas is indicated by G and the flow of the exhaust gas is indicated by arrows) discharged from the internal combustion engines and introduced into the exhaust gas purifying apparatus 10 flows into one cell 41 that opens onto an end face 40*a* of the exhaust gas inlet side in the honeycomb filter 40, and passes through a cell wall 42 separating the cell 41. At this time, PMs in the exhaust gas are captured in the cell wall 42, and as a result, the exhaust gas is purified. The purified exhaust gas flows out through another cell 41 opening onto the end face 40*b* of the exhaust gas outlet side, and is discharged to the outside.

Figure 2A:
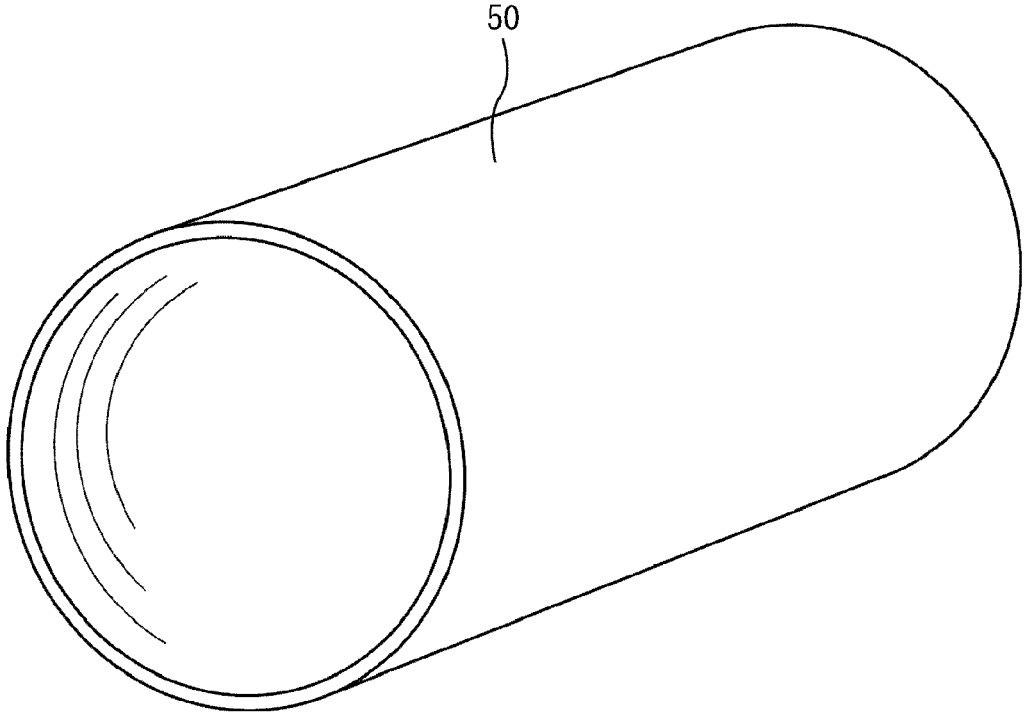
FIG. 2A is a perspective view schematically illustrating an appearance of a casing base included in a metal casing before installation of an exhaust gas treating body.
Figure 2B:
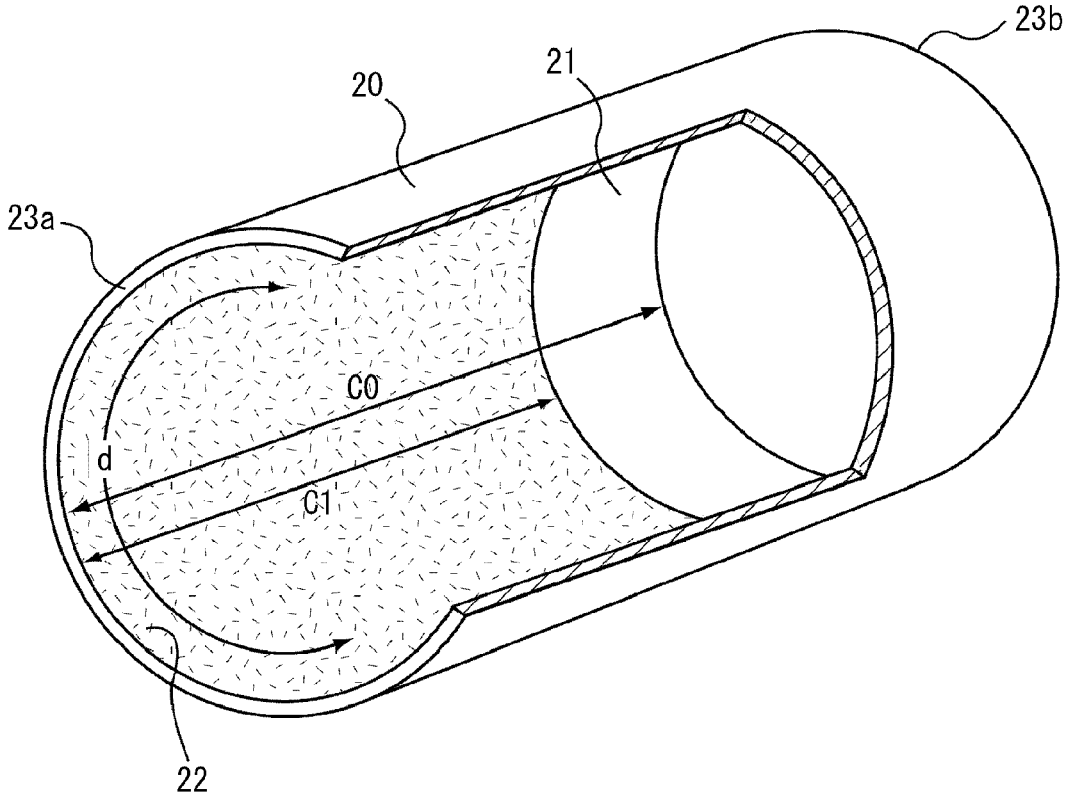
FIG. 2B is a partly broken away perspective view of the metal casing included in the exhaust gas purifying apparatus of an embodiment of the present invention.

Next, the description is given on the metal casing included in the exhaust gas purifying apparatus of the present embodiment. First, a casing base as a precursor of a metal casing is described, and then, the metal casing of the present embodiment is described. FIG. 2A is a perspective view schematically illustrating an appearance of a casing base included in a metal casing before installation of an exhaust gas treating body. FIG. 2B is a partly broken away perspective view of the metal casing included in the exhaust gas purifying apparatus of the present embodiment of the present invention.

A casing base 50 illustrated in FIG. 2A mainly includes a metal such as a stainless steel and has a cylindrical external shape. The inner diameter of the casing base 50 is slightly shorter than the total length of the diameter of the end face of the honeycomb filter 40 and the thickness of the holding sealing material 30 wounded around the honeycomb filter 40. The length of the casing base 50 is substantially the same as the length of the honeycomb filter 40 in its longitudinal direction (direction shown by arrow a in FIG. 4).

The casing base 50 illustrated in FIG. 2A is before installing an exhaust gas treating body therein and a corrosion area is not yet present in the inner surface of the casing base 50. The reason for this is described later in the description of the method for manufacturing an exhaust gas purifying apparatus.

In the present description, the longitudinal direction of the metal casing refers to the same direction as the longitudinal direction of the honeycomb filter 40 installed in the exhaust gas purifying apparatus.

Next, the metal casing 20 is described. FIG. 2B illustrates only the metal casing 20 after removing the holding sealing material 30 and the exhaust gas treating body 40 from the exhaust gas purifying apparatus 10 (see FIG. 1) of the present embodiment. The metal casing 20 has the opposite surface 21 facing to the holding sealing material 30 (not illustrated) and the opposite surface 21 has a corrosion area 22 in which a base material of the metal casing 20 (i.e. casing base 50) is corroded. The formed corrosion area 22 covers the entire circumference along the direction (direction shown by arrow d in FIG. 2B) of the inner periphery in the inner surface of the metal casing 20 and covers an area having the length C1 that is corresponding to about 70% of the entire length C0 of the opposite surface 21 (inner surface) from one end portion 23*a* to the other end portion 23*b* of the metal casing 20. Namely, the corrosion area covers the entire inner circumference of the inner surface and is in a range from about 10% to about 70% of the total length of the inner surface from one end to the other end in the longitudinal direction of the metal casing. In FIG. 2B, the end portions of the corrosion area 22 has clear boundaries so as to facilitate the understanding of the configuration. However, the end portions of the corrosion area 22 may not have clear boundaries as illustrated in FIG. 2B and the boundaries may be partially projected or partially recessed in the longitudinal direction of the metal casing 20 (i.e. corrugated boundaries along the direction of the inner periphery).

Since the casing base 50 forming the metal casing 20 includes a stainless steel, the corrosion area 22 includes corrosion products (e.g. rust and an oxide reaction product such as an oxide and a hydroxide) produced by corrosion of the stainless steel. In the corrosion area 22, the corrosion products having various shapes (e.g. simple projected and recessed shapes, burr shape, substantially spike-mound shape, zigzag shape, hook shape, and flake shape formed by a partial detachment of the surface in a certain size) are present in a random placement or in a random direction. On the other hand, the holding sealing material 30 includes an inorganic fiber aggregated body containing the inorganic fibers each having a predetermined length, and therefore, the inorganic fibers forming the holding sealing material 30 and the corrosion products present in the corrosion area 22 are complicatedly hooked to one another. This tends to generate high abrasion resistance between the metal casing 20 and the holding sealing material 30. Since the corrosion products are present in a random placement and in a random direction, the excellent abrasion resistance is more likely to be exerted against a displacement of the holding sealing material 30 in the longitudinal direction of the metal casing 20, a displacement of the holding sealing material 30 in the direction of the inner periphery of the metal casing 20 (a rotational displacement about the axis in the longitudinal direction of the metal casing 20), or a displacement caused by the combination of these. As a result, a displacement of the exhaust gas treating body in any direction is more likely to be prevented.

The inner surface of the metal casing may be corroded chronologically and naturally in normal use of the exhaust gas treating body. Such natural corrosion develops slowly, and therefore, the abrasion resistance between the metal casing and the holding sealing material by the corrosion in the metal casing is less likely to be enhanced immediately after the manufacture of the exhaust gas purifying apparatus. Even after prolonged use of the exhaust gas purifying apparatus, corrosion of the metal casing is less likely to develop so much. At least, the corrosion may not develop enough to be entangled with the inorganic fibers forming the holding sealing material.

On the other hand, the metal casing included in the exhaust gas purifying apparatus of the present embodiment has an artificially-formed corrosion area in a predetermined range, for example, prior to mounting thereof in an auto body for actual use of the exhaust gas purifying apparatus. Accordingly, the abrasion resistance between the metal casing and the holding sealing material is already sufficiently high immediately after the assembly of the exhaust gas purifying apparatus. Because of this, the holding sealing material is more likely to be fixed to the metal casing firmly even before the use of the exhaust gas purifying apparatus is started (e.g. at the time of transport of the exhaust gas purifying apparatus, at the time of mounting of the exhaust gas purifying apparatus in an auto body). As a result, a displacement or drop of the exhaust gas treating body is more likely to be prevented.

Figure 3:
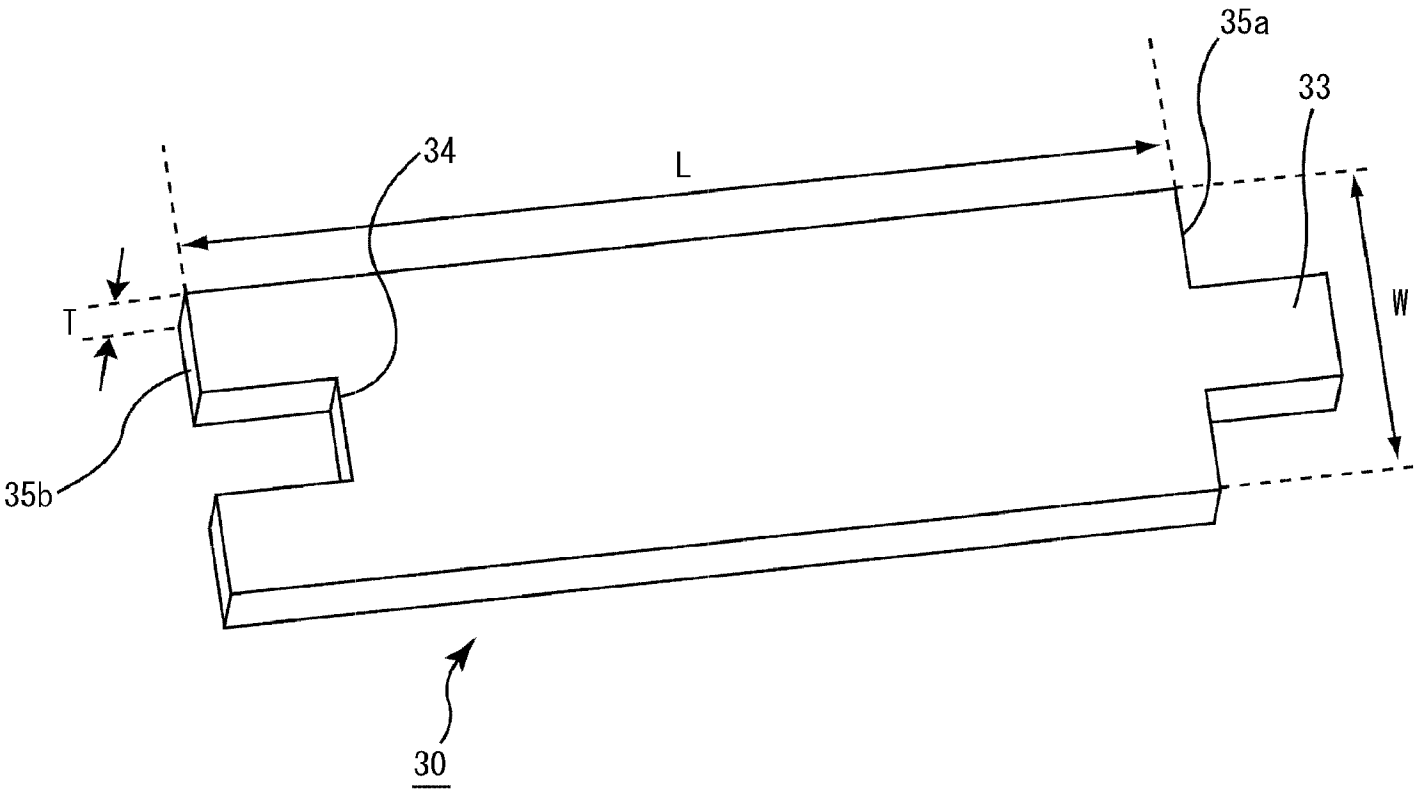
FIG. 3 is a perspective view schematically illustrating a holding sealing material according to an embodiment of the present invention.

FIG. 3 is a perspective view schematically illustrating a holding sealing material of the present embodiment. As illustrated in FIG. 3, the holding sealing material 30 of the present embodiment has a plate-like body in a rectangular shape in a plan view having a predetermined length (indicated by arrow L in FIG. 3), width (indicated by arrow W in FIG. 3), and thickness (indicated by arrow T in FIG. 3).

The holding sealing material 30 has end faces 35*a* and 35*b*. A projected portion 33 is formed on the end face 35*a* and a recessed portion 34 is formed on the end face 35*b*. The projected portion 33 and the recessed portion 34 are shaped to be engaged with each other when the holding sealing material 30 is wound around the exhaust gas treating body in the assembly of the exhaust gas purifying apparatus described later.

The holding sealing material 30 may include a needle mat including an inorganic fiber aggregated body formed by entangled inorganic fiber. The needle mat is manufactured by carrying out needling treatment on a base mat including inorganic fibers. The needling treatment refers to a treatment in which a fiber entangling device such as a needle is inserted into and pulling out from the base mat. The needle mat has a structure in which the comparatively-long inorganic fibers are entangled with one another three-dimensionally by the needling treatment, and a binder is present in the structure in which the inorganic fibers are entangled so as to reinforce the entangled structure of the inorganic fibers. Accordingly, since the needle mat is likely to maintain its shape owing to the entangled inorganic fibers, only a small amount of the binder is required for reinforcing the entangled structure. In order to form the entangled structure, the inorganic fibers have a certain fiber length. For example, the average fiber length of the inorganic fibers may be about 0.5 cm to about 10 cm.

Figure 4:
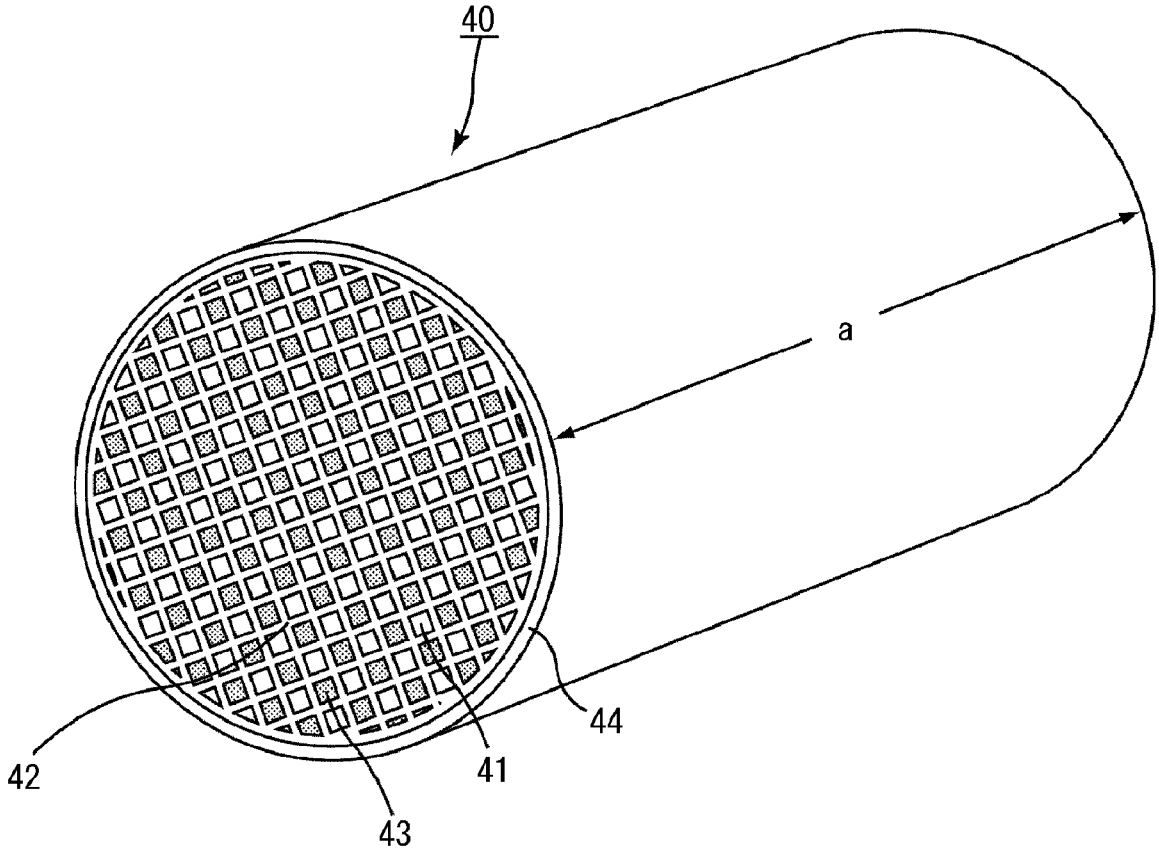
FIG. 4 is a perspective view schematically illustrating a honeycomb filter included in an exhaust gas purifying apparatus according to an embodiment of the present invention.

Next, the following will discuss a honeycomb filter included in the exhaust gas purifying apparatus with reference to FIG. 4.

FIG. 4 is a perspective view schematically illustrating a honeycomb filter included in the exhaust gas purifying apparatus of the present embodiment.

As illustrated in FIG. 4, a honeycomb filter 40 mainly includes a porous ceramic and has a round pillar shape. Moreover, a sealing material layer 44 is formed on the periphery of the honeycomb filter 40 for the purposes of reinforcing the peripheral portion of the honeycomb filter 40, adjusting the shape of the peripheral portion thereof, and improving the heat insulating property of the honeycomb filter 40.

The internal configuration of the honeycomb filter 40 has been already stated in the description of the exhaust gas purifying apparatus of the present embodiment (refer to FIG. 1B).

Next, a method for manufacturing an exhaust gas purifying apparatus of the present embodiment is described.

The method for manufacturing an exhaust gas purifying apparatus of the present embodiment includes: winding a holding sealing material around an exhaust gas treating body to manufacture a wound body; housing the wound body in a casing base; and introducing a corrosive agent into the holding sealing material from one or both ends of the holding sealing material to corrode an inner surface of the casing base. Hereinafter, each process including a manufacturing process of a holding sealing material is described.

(1) Manufacturing Process of a Holding Sealing Material

A holding sealing material includes a needle mat. The needle mat is manufactured by carrying out the needling treatment on a base mat. The base mat has a structure in which inorganic fibers having the predetermined average fiber length are loosely entangled with one another through a spinning process. By carrying out the needling treatment on the inorganic fibers thus loosely entangled with one another, the inorganic fibers are entangled with one another more complicatedly so that a mat having an entangled structure that can maintain its shape to a certain degree without the presence of a binder tends to be formed.

Although not particularly limited, examples of the inorganic fibers include alumina fibers, ceramic fibers and silica fibers. These materials may be altered depending on properties and the like required for the holding sealing material, such as heat resistance and wind erosion resistance. When alumina fibers are used as the inorganic fibers, fibers having, for example, a composition ratio of alumina:silica=about (60:40) to about (99:1) may be used.

Here, the needling treatment may also be carried out by using a needling device. The needling device is configured by: a supporting plate for supporting the base mat; and a needle board that is disposed above this supporting plate and capable of moving in a reciprocating manner in a sticking direction (thickness direction of the base mat). A large number of needles are attached to the needle board. This needle board is shifted relative to the base mat mounted on the supporting plate, and the large number of needles are inserted into and removed from the base mat so that the inorganic fibers forming the base mat tends to be entangled complicatedly. The number of the needling treatment and the number of the needles can be altered in accordance with the target bulk density, weight per square meter, and the like.

(2) Adhesion Process of Binder Solution

A binder is allowed to adhere to the needle mat that has undergone the needling treatment. By allowing the binder to adhere to the needle mat, the entangled structure of the inorganic fibers tends to be firmer, and the volume of the needle mat tends to be suppressed.

An emulsion prepared by dispersing a binder, such as an acrylic-based latex and a rubber-based latex, in water may be used as the binder solution. This binder solution is sprayed evenly over the entire needle mat by using a spray or the like so that the binder solution is allowed to adhere to the needle mat.

Thereafter, in order to remove moisture in the binder solution, the needle mat is dried. At this moment, as needed, the needle mat may be dried while compressed. The drying and compressing conditions may be set, for example, to the temperature of about 100° C. to about 200° C. under a pressure of about 30 kPa to about 200 kPa for about 3 minutes to about 20 minutes. The dried needle mat was cut into a predetermined shape to manufacture the holding sealing material of the present embodiment.

Referring to the drawings, the following description will discuss a method for manufacturing an exhaust gas purifying apparatus in which a thus-manufactured holding sealing material is used.

Figure 5:
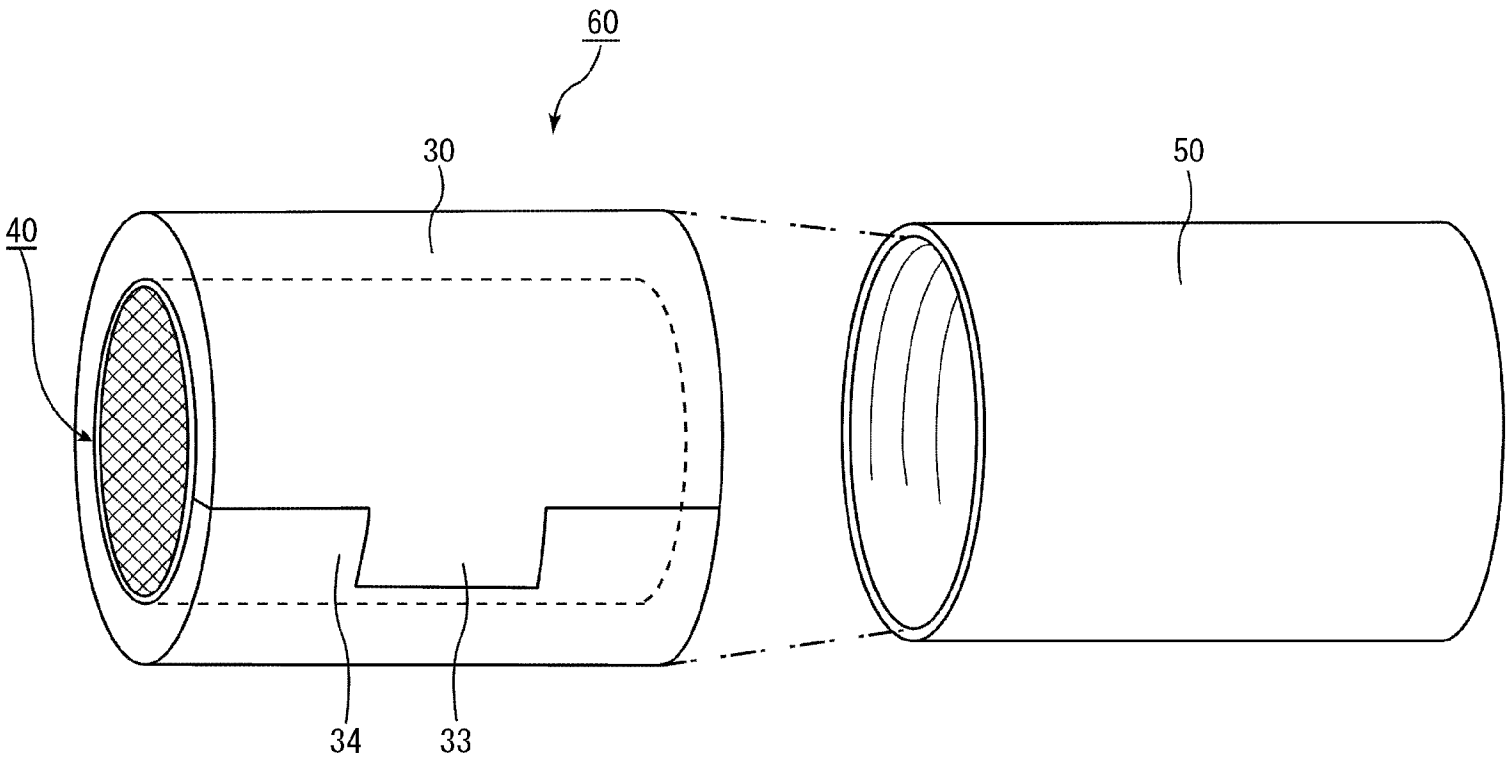
FIG. 5 is a perspective view schematically illustrating the procedure of manufacturing an exhaust gas purifying apparatus according to the embodiment of the present invention.

FIG. 5 is a perspective view schematically illustrating the procedure of manufacturing an exhaust gas purifying apparatus of the present embodiment.

A holding sealing material 30 manufactured as described above is wound around the periphery of a round pillar-shaped honeycomb filter (exhaust gas treating body) 40 manufactured by a conventionally known method, with its projected portion 33 and recessed portion 34 being engaged with each other. Then, as illustrated in FIG. 5, the honeycomb filter 40 around which the holding sealing material 30 has been wound (i.e. wound body 60) is press-fitted into a casing base 50 in a round pillar shape having a predetermined size, mainly including a metal and the like; thus, a press-fit body is manufactured.

Here, the internal diameter of the metal casing 20 is a little smaller than the diameter of the outermost diameter including the thickness of the holding sealing material 30 of the honeycomb filter 40 around which the holding sealing material 30 has been wound. This is for allowing the compressed holding sealing material after being press-fitted to exert a predetermined repulsive force (i.e. force to hold a honeycomb filter).

Figure 6:
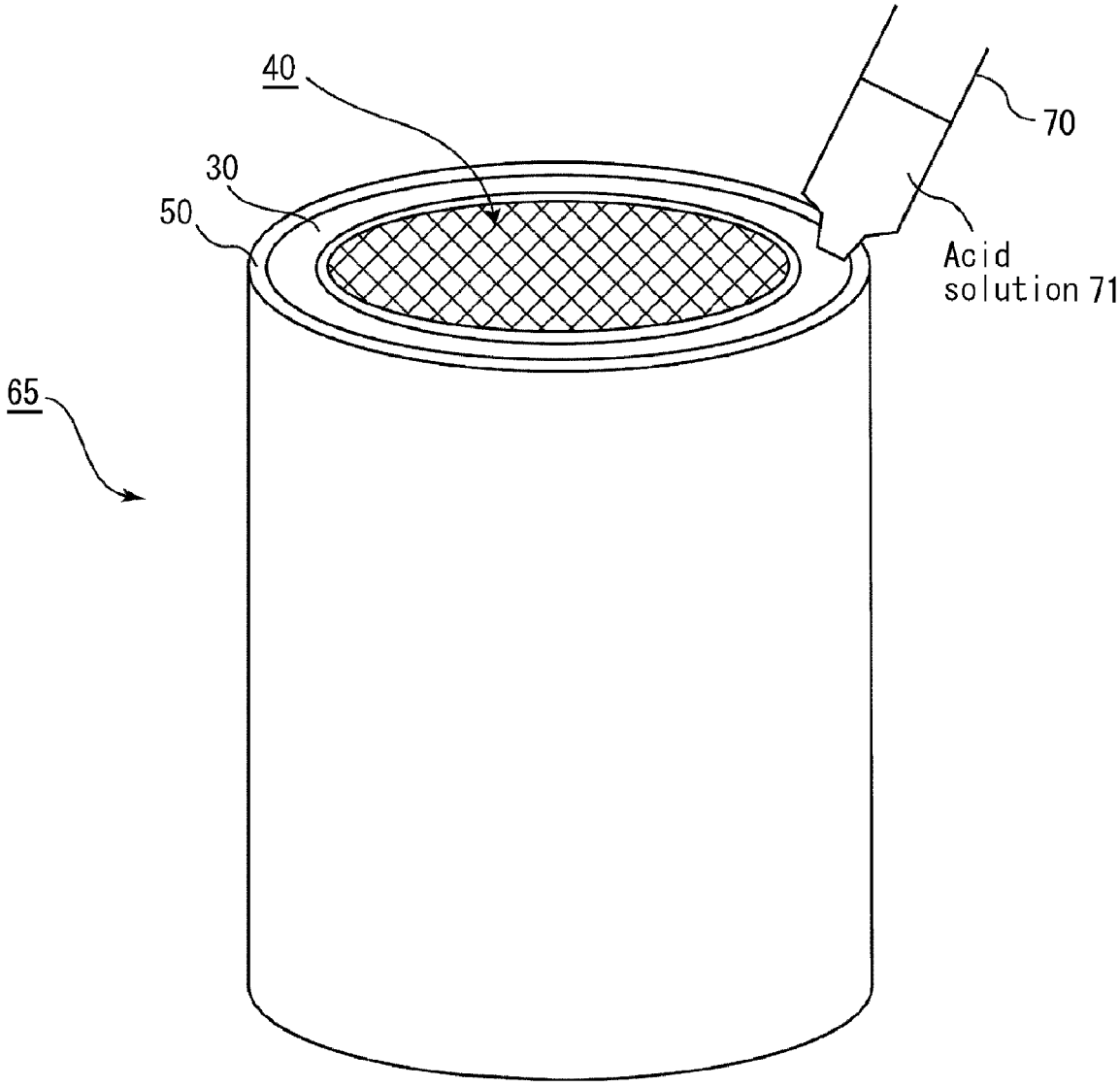
FIG. 6 is a view schematically illustrating a corrosion process in which a corrosive agent is introduced into a holding sealing material.

In the method for manufacturing an exhaust gas purifying apparatus of the present embodiment, a corrosive agent is introduced, after the housing process, into the holding sealing material from one or both end portions of the holding sealing material to corrode the inner surface of the metal casing. FIG. 6 is a view schematically illustrating a corrosion process in which a corrosive agent is introduced into the holding sealing material.

First, a corrosive agent to be used in the corrosion process is prepared. In the present embodiment, an acid solution containing hydrochloric acid is used as a corrosive agent. Water is used as a solvent of the acid solution and the concentration of hydrogen chloride in the acid solution may be set to around 1 mol/l. The amount of the acid solution may be changed as appropriate so that the corrosive area corresponding to the desired abrasion resistance is formed. For example, it may be around 10 to 80 ml. The temperature of the acid solution is not particularly limited, and the acid solution at room temperature or the warmed acid solution may be used.

Next, the prepared corrosive agent is introduced into the holding sealing material from the end portion of the holding sealing material. A press-fit body 65 is placed with its longitudinal direction oriented vertically and introduction of the corrosive agent is started as illustrated in FIG. 6. Since the corrosive agent of the present embodiment is the acid "solution", the weight of the corrosive agent and the capillarity of the holding sealing material allow the corrosive agent introduced from one end portion of the holding sealing material to more easily permeate toward the other end portion of the holding sealing material. Further, leakage of the corrosive agent from the end portion of the holding sealing material is less likely to occur compared to the case where the press-fit body 65 is placed with its longitudinal direction oriented horizontally.

More specifically, an acid solution 71 is injected into an injection instrument 70 (e.g. syringe) in which the flow rate of the content can be set as required. The injection instrument 70 discharges the acid solution 71 slowly toward a space between the holding sealing material 40 and the casing base 50. Along with the discharge of corrosive agent, the injection instrument 70 is moved around the periphery of the holding sealing material 30 along the boundary between the holding sealing material 30 and the casing base 50. Thus, the acid solution 71 as the corrosive agent is introduced into the holding sealing material 30. It is desirable to keep the constant flow rate of the corrosive agent and the constant rate of moving the injection instrument as far as possible so as to avoid unevenness in the introduction amount of the corrosive agent in the direction of the inner periphery. The flow rate of the corrosive agent from the injection instrument is not particularly limited. Based on the check with regard to the absorption and permeation of the corrosive agent into the holding sealing material, the corrosive agent may be discharged from the injection instrument at a rate not to cause the overflow of the corrosive agent from the holding sealing material having absorbed the corrosive agent to its limit. The acid solution may be discharged in liquid state, or alternatively, the acid solution may be sprayed.

The corrosive agent thus introduced into the holding sealing material permeates through the whole holding sealing material. Then, the contact between the corrosive agent and the inner surface of the casing base causes the corrosion in the inner surface of the casing base.

Thereafter, the drying process is carried out to sufficiently dry the holding sealing material in which the acid solution has been introduced. Hot-air drying may be employed as a drying method. The conditions for drying may be changed in accordance with the amount of the corrosive agent introduced into the holding sealing material. For example, in a case where about 40 ml of the corrosive agent is introduced into the holding sealing material, the holding sealing material may be dried by hot air at a temperature from about 60° C. to about 150° C. for about 20 minutes to about 90 minutes.

After the introduction of the acid solution as the corrosive agent into the holding sealing material, the inner surface of the casing base needs to be sufficiently corroded by the corrosive agent. In view of this, the corrosion process in the method for manufacturing an exhaust gas purifying apparatus of the present embodiment includes maintenance process after the introduction of the corrosive agent into the holding sealing material and before the drying process. The maintenance process is for allowing the holding sealing material into which the corrosive agent has been introduced to stand for a predetermined time without performing any operation thereon so that the corrosion of the casing base by the corrosive agent develops sufficiently.

The corrosion develops even after the holding sealing material into which the corrosive agent has been introduced is dried. However, the rate of corrosion development is lowered and the desired corrosion mass may not be obtained. The solution corrosive agent allows easy development of the corrosion (e.g. electrochemical reaction) of the casing base by the corrosive agent. Consequently, the corrosive area tends to be easily formed and the time for forming the corrosion area tends to be shortened.

The time for the maintenance process is not particularly limited and may be determined in accordance with the kind or the amount of the corrosive agent to be used. For example, in the case of corroding the inner surface of the stainless-steel casing base having a diameter of about 80 mm by about 40 ml of hydrochloric acid (about 1 mol/l), the maintenance process may be carried out for about 600 seconds to about 3600 seconds.

The exhaust gas purifying apparatus of the present embodiment is manufactured in the above described manner.

In the method for manufacturing an exhaust gas purifying apparatus of the present embodiment, the corrosive agent is introduced into the holding sealing material after the housing of the exhaust gas treating body in the casing base, not before the housing thereof. In this manner, the exhaust gas treating body tends to be more easily housed in the casing base. In addition, formation of the corrosion area in the casing base is achieved simply by introducing the corrosive agent therein.

Hereinafter, effects of the exhaust gas purifying apparatus of the present embodiment and the method for manufacturing the same are listed.

(1) The exhaust gas purifying apparatus of the present embodiment has a corrosion area in which the base material is corroded in the inner surface of the metal casing (opposite surface). When such a corrosion area and the inorganic fibers forming the holding sealing material are entangled complicatedly, the abrasion resistance between the holding sealing material and the metal casing tends to be greatly increased. Accordingly, the displacement of the holding sealing material, which holds the exhaust gas treating body, is more likely to be prevented in the metal casing. As a result, the displacement or drop of the exhaust gas treating body is more likely to be prevented.

(2) In the exhaust gas purifying apparatus of the present embodiment, the abrasion resistance occurs between the metal casing and the holding sealing material as long as they are in contact with each other. Therefore, even when the metal casing is thermally expanded due to high-temperature exhaust gases, the abrasion resistance occurs as long as the contact between the metal casing and the holding sealing material is kept.

This tends to allow firm fixing of the exhaust gas treating body so that the displacement or drop of the exhaust gas treating body is more likely to be prevented.

(3) In the exhaust gas purifying apparatus of the present embodiment, the corrosion area is artificially formed in the inner surface of the metal casing by the corrosive agent. Accordingly, the range of the corrosion area is likely to be controlled as required so that the abrasion resistance between the metal casing and the holding sealing material is easily adjusted to the degree sufficient to hold and fix the exhaust gas treating body. In addition, the corrosion area is formed by a simple method of contacting the metal casing with the corrosive agent. Accordingly, an expensive device or a complicated procedure is less likely to be needed in manufacturing the exhaust gas purifying apparatus. As a result, the exhaust gas purifying apparatus is more likely to be easily manufactured.

(4) In the exhaust gas purifying apparatus of the present embodiment, the formed corrosion area covers the substantially entire inner circumference of the inner surface and is in the range from about 10% to about 70% of the total length of the inner surface from one end portion to the other end portion in the longitudinal direction of the metal casing. The corrosion area formed in such a range tends to secure the sufficient abrasion resistance between the metal casing and the holding sealing material to fix the exhaust gas treating body. Further, even in the case of altering the needed abrasion resistance in accordance with the size and the like of the exhaust gas treating body to be used, simple change in the range of the corrosion area may change the degree of the abrasion resistance. Accordingly, a special jig corresponding to each size of the exhaust gas treating body is less likely to be needed so that the exhaust gas purifying apparatus is more likely to be manufactured easily and efficiently.

(5) In the method for manufacturing an exhaust gas purifying apparatus according to the present embodiment, a simple method is employed as a procedure for forming the corrosion area in the inner surface of the casing base. The simple method includes: housing the exhaust gas treating body in the casing base by interposing the holding sealing material therebetween; and introducing the corrosive agent from the end portion of the holding sealing material. Accordingly, the exhaust gas purifying apparatus according to the present embodiment, in which the corrosion area is formed in the inner surface of the metal casing, is more likely to be manufactured easily and efficiently.

(6) Change of the kind and the amount of the corrosive agent more easily controls the corrosion mass and the size of the corrosion area to the desired value. Therefore, even when the abrasion resistance required in actual use needs to be changed due to the modifications in the size and the like of the exhaust gas treating body, preparation of a special jig or a significant change in the procedure is not needed. Accordingly, the exhaust gas treating body is more easily manufactured.

(7) In the method for manufacturing an exhaust gas purifying apparatus of the present embodiment, an acid solution is used as a corrosive agent. Since the corrosive agent exerts great corrosive action in the metal casing, the required corrosion mass is more easily obtained as well as the satisfactory decrease in the used amount of the corrosive agent and the corrosion time. In addition, the use of the above corrosive agent more easily secures the safe operation.

(8) The method for manufacturing an exhaust gas purifying apparatus according to the present embodiment includes the drying process of the holding sealing material after the corrosion process thereof. This process allows immediate operation of the next process (e.g. finishing, inspection, assembling to auto body, and the like) so that manufacture efficiency of the exhaust gas purifying apparatus is more likely to be enhanced.

EXAMPLES

The following description will discuss an example that specifically discloses the first embodiment of the present invention. Here, the present invention is not intended to be limited only by the example.

In the example, the exhaust gas purifying apparatus is manufactured and a punching shear strength test and a visual observation of the inner surface of the metal casing are carried out.

Example 1

(1) Manufacture of a Holding Sealing Material

A base mat having a compounding ratio of $Al_2O_3$:$SiO_2$=72:28 was prepared as a base mat including alumina fibers having an alumina-silica composition. The needle treating mat having a bulk density of 0.15 g/cm$^3$ and a weight per square meter of 1050 g/m$^2$ was manufactured by carrying out needling treatment on this base mat.

Separately, an acrylic latex emulsion in which an acrylic latex is dispersed in water was prepared and this was used as a binder solution.

Next, the needle treating mat was cut into a size of 265 mm×83 mm in a plan view. The binder solution was sprayed evenly over the cut needle treating mat by using a spray so as to give 1.0% by weight of the binder with respect to the amount of alumina fibers in the cut needle treating mat, so that the binder solution was allowed to adhere to the mat.

Then, the needle treating mat with the binder solution adhered thereto was dried by through air at 140° C. under the pressure of 70 kPa for five minutes, so that a holding sealing material in the shape illustrated in FIG. 3 was manufactured.

(2) Manufacture of a Wound Body

A round pillar-shaped exhaust gas treating body mainly including a porous ceramic (diameter: 80 mm, total length: 95 mm) was prepared. In addition, a cylindrical casing base including a stainless steel (inner diameter: 88 mm, total length: 115 mm) was prepared.

Next, the holding sealing material manufactured in the process (1) was wound around the outer periphery of the prepared exhaust gas treating body in such a manner that the projected portion and the recessed portion on the end portions of the holding sealing material was engaged with each other. As a result, the wound body was obtained.

(3) Press-Fitting of a Wound Body into a Casing Base

Press fitting was carried out with use of a press-fitting jig for facilitating press-fitting of the wound body into the casing base. In the press-fitting jig, one end portion has the outer diameter slightly smaller than the inner diameter of the casing base and the other end portion has the inner diameter at least the same as the outer diameter of the wound body. Accordingly, the press-fitting jig as a whole has a cylinder shape which is tapered from one end to the other end. The end portion with the shorter diameter of the press-fitting jig was fitted into the casing base and fixed to each other. The wound body was pressed to the end portion with the longer diameter of the press-fitting jig so that the position of the wound body before the press fitting thereof was determined. Then, the wound body was press-fitted in such a manner that the whole wound body was placed inside the casing base.

(4) Introduction of a Corrosive Agent into a Holding Sealing Material

First, about 40 ml of hydrochloric acid (1 mol/l) was prepared. The prepared hydrochloric acid was injected into a glass syringe. On the other hand, the wound body was raised as shown in FIG. 6 with its end face in contact with the base so that the longitudinal direction thereof is vertically oriented. The outlet of the syringe was positioned in the vicinity of the boundary between the casing base and the holding sealing material. While discharging the hydrochloric acid at the rate of about 5 ml/second, the syringe was moved around the entire circumference of the holding sealing material along the above boundary. Accordingly, the hydrochloric acid was introduced into the holding sealing material.

After the introduction of the corrosive agent into the holding sealing material, the holding sealing material was allowed to stand without any operation performed thereon for 3600 seconds so that the inner surface of the casing base is corroded sufficiently.

(5) Drying of a Press-Fit Body

The corroded press-fit body was placed in a hot-air dryer in which the temperature was set to 110° C. for 60 minutes so that the corrosive agent was sufficiently dried. Consequently, the exhaust gas purifying apparatus of the present embodiment was manufactured.

Comparative Example 1

An exhaust gas purifying apparatus was manufactured in the same manner as in Example 1, except that the corrosive agent was not introduced.

(Punching Shear Strength Test)

The punching shear strength was measured with respect to each of the exhaust gas purifying apparatus manufactured in Example 1 and Comparative Example 1.

Figure 7A:
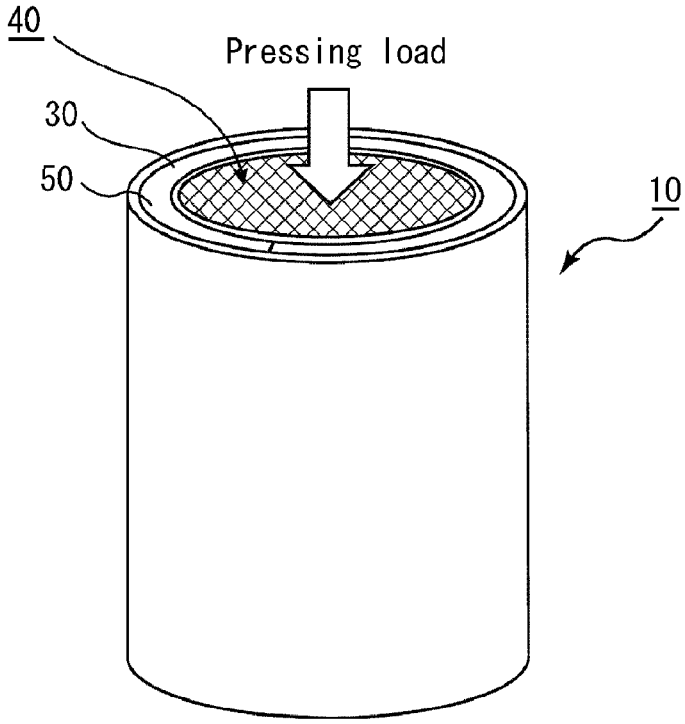
FIG. 7A is a perspective view schematically illustrating a procedure of a punching shear strength test.
Figure 7B:
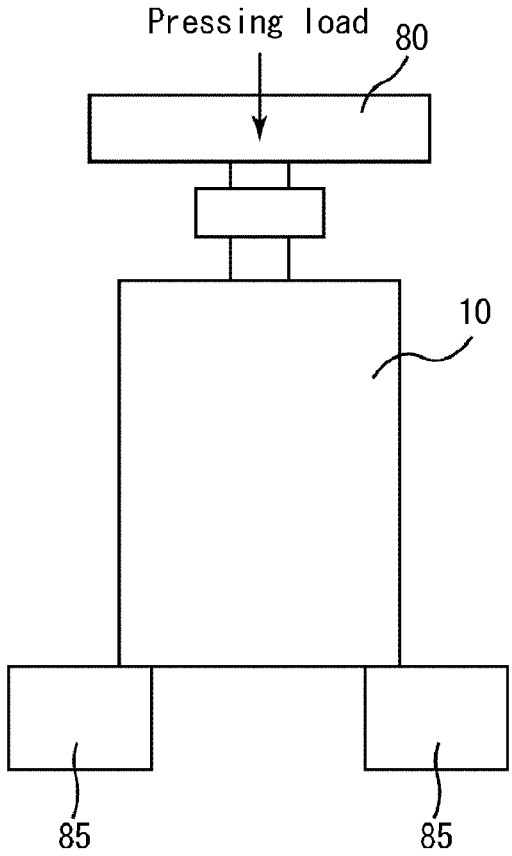
FIG. 7B is a front view schematically illustrating a punching shear strength test apparatus.

More specifically, as shown in FIG. 7A and FIG. 7B, the exhaust gas purifying apparatus 10 was placed on boards 85 and an aluminum jig 80 having the diameter of 30 mm applied the pressing load (Pressing rate: 1 mm/min.) on the exhaust gas treating body 40. The maximum value of the pressing load (N) at the time when the wound body (i.e. the exhaust gas treating body 40 wound with the holding sealing material 30) was punched was determined as the punching shear strength that is the holding force between the holding sealing material and the metal casing. It is to be noted that Instron Universal Testing Machine (5582 type) was used to determine the strength.

(Observation of the Inner Surface of a Metal Casing)

The inner surface of the metal casing was observed by an overview picture and a SEM picture (magnification: 500 times) so that the corrosion of the inner surface was checked.

Figure 8:
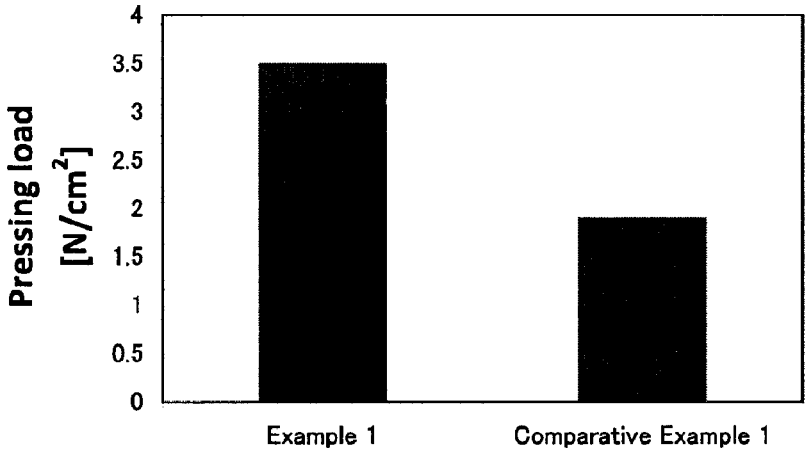
FIG. 8 is a graph showing a result of the punching shear strength test in Example 1 and Comparative Example 1 according to the first embodiment.
Figure 9A:
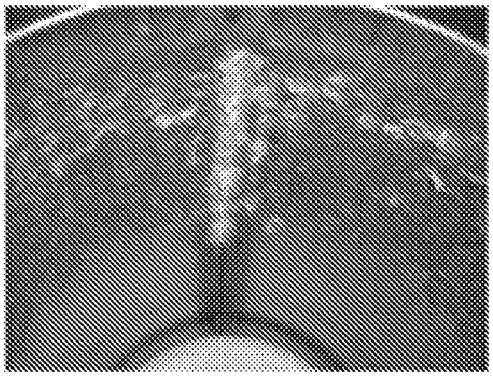
FIG. 9A is a picture showing an overview of an inner surface of a metal casing in Example 1.
Figure 9B:
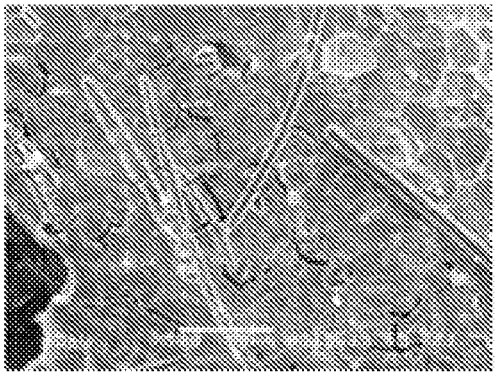
FIG. 9B is a SEM picture showing the inner surface of the metal casing in Example 1.
Figure 9C:
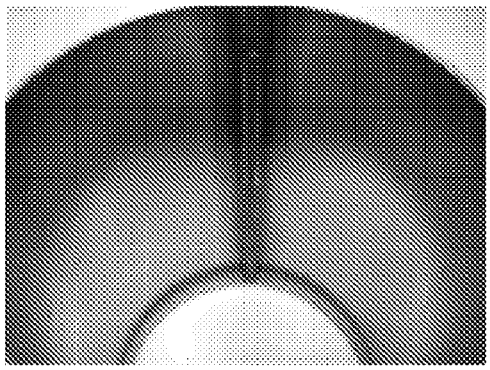
FIG. 9C is a picture showing an overview of an inner surface of a metal casing in Comparative Example 1.
Figure 9D:
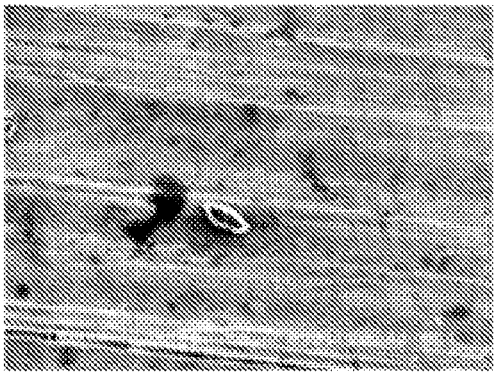
FIG. 9D is a SEM picture showing the inner surface of the metal casing in Comparative Example 1.

FIG. 8 is a graph showing a result of the punching shear strength test in Example 1 and Comparative Example 1 according to the first embodiment. FIG. 9A is a photo showing an overview of the inner surface of the metal casing in Example 1. FIG. 9B is a SEM picture showing the inner surface of the metal casing in Example 1. FIG. 9C is a picture showing an overview of the inner surface of the metal casing in Comparative Example 1. FIG. 9D is a SEM picture showing the inner surface of the metal casing in Comparative Example 1.

As a result, the punching shear strength measured in Example 1 was 3.5 N/cm$^2$ and the punching shear strength measured in Comparative Example 1 was 1.9 N/cm$^2$. As clearly seen from FIG. 8, the exhaust gas purifying apparatus with a corrosion area formed therein in Example 1 achieved the excellent punching shear strength. Therefore, the exhaust gas purifying apparatus presumably exerts high holding force to hold the exhaust gas treating body without the addition of an expansive agent to the inorganic fiber aggregated body or the increase in the bulk density of the holding sealing material after the assembly thereof.

On the other hand, the punching shear strength measured in Comparative Example 1 was a low value as 1.9 N/cm$^2$, and therefore, the above-mentioned arrangement for enhancing the holding force of the holding sealing material is presumably needed.

As shown in FIG. 9A and FIG. 9B, in the observation of the inner surface of the metal casing, even the overview picture shows the corrosion of the inner surface in Example 1. The SEM picture shows the presence of various corrosion products in various shapes such as recessed and projected shapes and a substantially spike-mound shape on the surface.

This observation results indicates that the exhaust gas purifying apparatus of Example 1 is presumably more likely to exert high holding force because of the corrosion products and inorganic fibers hooked and entangled to each other in the corrosion area.

On the other hand, as shown in FIG. 9C and FIG. 9D, the inner surface of the metal casing of Comparative Example 1 does not especially have irregularities or projections, which does not contribute to enhancement of the abrasion resistance between the metal casing and the holding sealing material.

Second Embodiment

In the exhaust gas purifying apparatus of the present embodiment, the corrosion area is formed by a chloride solution, not by hydrochloric acid.

Hereinafter, an exhaust gas purifying apparatus in which the corrosion area is formed by a chloride solution containing sodium chloride as a chloride, and a method for manufacturing an exhaust gas purifying apparatus are described.

The exhaust gas purifying apparatus of the present embodiment has a similar configuration as the exhaust gas purifying apparatus of the first embodiment, except that the corrosion area is formed by sodium chloride solution.

The degree of the corrosion of the casing base depends on the concentrations of sodium chloride solution and hydrochloric acid. Here, since sodium chloride solution has the lower corrosivity than hydrochloric acid, the degree of the corrosion by sodium chloride solution is generally smaller than that by hydrochloric acid when they have the same mol concentration.

In the method for manufacturing an exhaust gas purifying apparatus of the present embodiment, a chloride solution is used as a corrosive agent, and more specifically, sodium chloride solution is used.

Water is used as a solvent and sodium chloride solution at a concentration of about 1 mol/l is prepared.

In the same manner as in the first embodiment, the prepared sodium chloride solution is introduced into the holding sealing material and then, the holding sealing material is allowed to stand for a predetermined time. Here, in view of the corrosivity of the sodium chloride solution, the holding sealing material may be allowed to stand for about 600 seconds to about 3600 seconds.

Then, the holding sealing material into which the corrosive agent has been introduced is dried at about 60° C. to about 150° C. for about 20 minutes to about 90 minutes. Accordingly, the exhaust gas purifying apparatus of the present embodiment is manufactured.

Hereinafter, effects of the exhaust gas purifying apparatus of the present embodiment and the method for manufacturing an exhaust gas purifying apparatus are listed.

In the exhaust gas purifying apparatus of the present embodiment and the method for manufacturing an exhaust gas purifying apparatus, the above described effects (1) to (8) are obtained.

(9) In addition, since the sodium chloride solution only generates decomposed materials of the components of the solution (e.g. sodium chloride and the like), the environmental safety is more likely to be achieved at the high level.

The following description will discuss an example that specifically discloses the second embodiment of the present invention. Here, the present invention is not intended to be limited only by the example.

Example 2

An exhaust gas purifying apparatus was manufactured in the same manner as in Example 1 in accordance with the first embodiment, except that 40 ml of sodium chloride solution having a sodium chloride concentration of 1 mol/l was used as the corrosive agent.

The punching shear strength test and the observation on the inner surface of the metal casing were carried out with respect to the exhaust gas purifying apparatus manufactured in Example 2 in the same manner as in Example 1.

Figure 10:
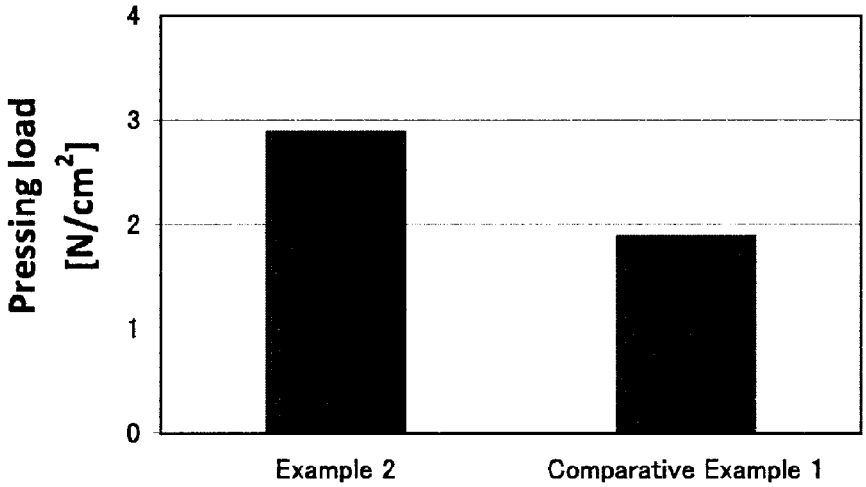
FIG. 10 is a graph showing a result of the punching shear strength test in Example 2 and Comparative Example 1 according to the second embodiment.
Figure 11A:
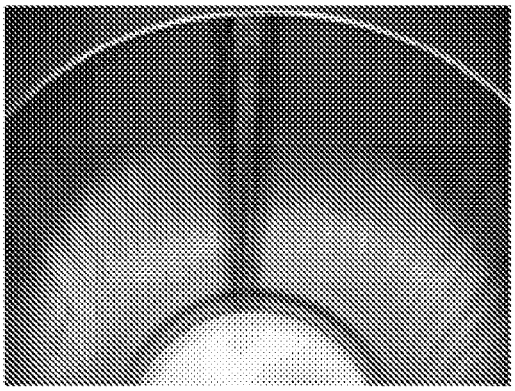
FIG. 11A is a picture showing an overview of an inner surface of a metal casing in Example 2.
Figure 11B:
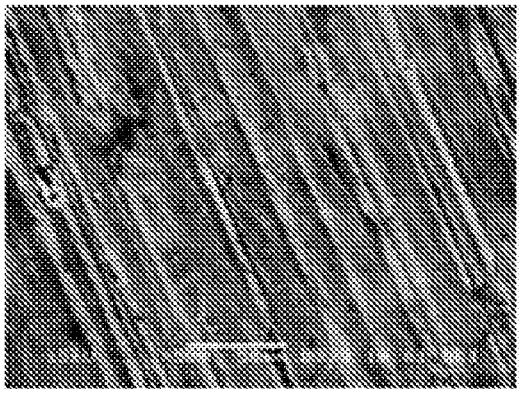
FIG. 11B is a SEM picture showing the inner surface of the metal casing in Example 2.

FIG. 10 is a graph showing a result of the punching shear strength test in Example 2 and Comparative Example 1 according to the second embodiment. FIG. 11A is a picture showing an overview of the inner surface of the metal casing in Example 2 of the second embodiment. FIG. 11B is a SEM picture showing the inner surface of the metal casing in Example 2 of the second embodiment. It is to be noted that the result of the punching shear strength test of Comparative Example 1 is shown in FIG. 10 for the reference. Further, the overview picture and the SEM picture of the inner surface of the metal casing in Comparative Example 1 are respectively shown in FIG. 11C and FIG. 11D.

The exhaust gas purifying apparatus of the Example 2 had a punching shear strength of 2.9 N/cm$^2$. As clearly seen from FIG. 10, the exhaust gas purifying apparatus with the corrosion area formed therein of Example 2 achieved the excellent punching shear strength. The excellent punching shear strength allows the exhaust gas purifying apparatus to hold the exhaust gas treating body more easily without the addition of an expansive agent to the inorganic fiber aggregated body or the increase in the bulk density of the holding sealing material after the assembly thereof.

Figure 11C:
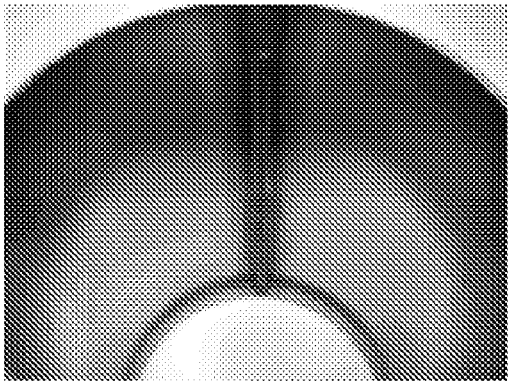
FIG. 11C is a picture showing an overview of an inner surface of a metal casing in Comparative Example 1.
Figure 11D:
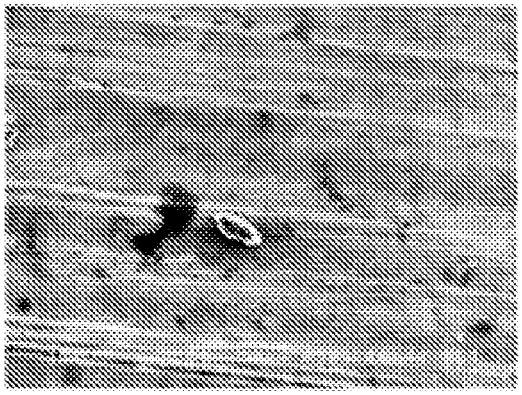
FIG. 11D is a SEM picture showing the inner surface of the metal casing in Comparative Example 1.

Further, as shown in FIG. 11A and FIG. 11B, the inner surface of the metal casing shown in the overview picture of Example 2 seems not to be significantly different from that of Comparative Example 1 (see FIG. 11C). However, the corrosion was found in the inner surface of the metal casing, especially in the welded portion of the metal casing. The needle-shaped corrosion products which were found in the exhaust gas purifying apparatus of Example 1 seemed not to be found in the SEM picture. However, the corrosion products in recessed and projected shapes were found. This observation results indicates that the exhaust gas purifying apparatus of Example 2 is also presumably more likely to exert high holding force because of such corrosion products and inorganic fibers hooked and entangled to each other in the corrosion area.

Another Embodiment

In the first embodiment, an acid solution is used as a corrosive agent and hydrochloric acid is used as the acid in the acid solution. However, the acid in the acid solution is not limited to hydrochloric acid, and it may be at least one of nitric acid, sulfuric acid, phosphoric acid, hydrofluoric acid, sulfonic acid, acetic acid, formic acid, carbonic acid, and boric acid.

Further, in the second embodiment, a chloride solution is used as a corrosive agent and sodium chloride is used as a chloride in the chloride solution. However, the chloride in the chloride solution is not limited to sodium chloride, and it may be at least one of chlorides of lithium, potassium, rubidium, caesium, beryllium, magnesium, calcium, strontium, barium, and radium.

In addition to the acid solution used in the first embodiment of the present invention and the chloride solution used in the second embodiment of the present invention, an oxidant solution may also be used as a corrosive agent. The oxidant in the oxidant solution is not particularly limited, and at least one of peroxy acid, hydrogen peroxide, permanganic acid, perchloric acid, hypochlorous acid, and their salts may be suitably used. Examples of the peroxy acid include perphosphoric acid, persulfuric acid, and percarbonate. Further, examples of the salt form may include sodium salt, potassium salt, and calcium salt.

The range of the corrosion area may cover the entire inner circumference of the metal casing as above described, or alternatively, it may cover apart of the inner circumference along the direction of the inner periphery (the inner circumference of the inner surface). In the case where the corrosion area covers a part of the inner circumference along the direction of the inner periphery (the inner circumference of the inner surface), the corrosion area may cover an area of about 25% or more and less than about 100% of the inner circumference. The corrosion area in such a range is more likely to provide the sufficient abrasion resistance between the metal casing and the holding sealing material.

Further, the range of the corrosion area in the longitudinal direction of the metal casing may cover the entire length of the metal casing, or alternatively, it may cover a part of the entire length. In the case where the corrosion area covers a part of the total length of the metal casing, the corrosion area may cover about 10% to about 70% of the total length of the metal casing. The corrosion area in such a range is more likely to provide the sufficient abrasion resistance between the metal casing and the holding sealing material.

Besides the above-mentioned stainless steel, the metal casing in the exhaust gas purifying apparatus according to the embodiment of the present invention may include a cast iron.

The stainless steel is not particularly limited as long as it has thermal resistance and is corroded by a corrosive agent. Examples thereof include martensitic stainless steels (e.g. SUS410, SUS410S, SUS410F2, SUS420J1, SUS431, SUS416, SUS420J2, SUS420F2, SUS420F and the like), ferritic stainless steels (e.g. SUS430, SUS409, SUH21, SUS410L, SUS430F, SUS430LX, SUS430J1L, SUS434, SUSXM27, SUH409L and the like), and austenitic stainless steels (e.g. SUS304, SUS301, SUS302, SUS303, SUS304L, SUS304J1, SUS305, SUS309S, SUS316, SUS321 and the like).

The cast iron is not particularly limited as long as it has thermal resistance and is corroded by a corrosive agent. Examples thereof include common cast irons, high-grade cast irons, special cast irons, and malleable cast irons.

Besides the above-mentioned cylindrical casing, the metal casing may be a clamshell casing, a size-reducible casing, and the like.

The shapes of a recessed portion and a projected portion that are formed on a shorter side of the holding sealing material according to the embodiments of the present invention are not particularly limited as long as the recessed portion can be engaged with the projected portion. In the case where one pair of a recessed portion and a projected portion is formed, desirably, the projected portion that projects over a size from about 20 mm in width× about 20 mm in length to about 100 mm in width× about 100 mm in length is formed on a part of one shorter side, and the recessed portion that can be engaged with the projected portion is formed on the other shorter side. In the case where an exhaust gas purifying apparatus is manufactured using the holding sealing material having such shapes of the recessed portion and the projected portion, an exhaust gas treating body tends to be surely held by the holding sealing material, leading to excellent handleability.

In addition, a plurality of pairs of the recessed portions and projected portions that are engaged with each other may be formed on the shorter side of the holding sealing material, or recessed portions and projected portions may not be formed thereon.

In the holding sealing material according to the embodiments of the present invention, the average fiber length of inorganic fibers is desirably from about 0.5 cm to about 10 cm, and more desirably from about 1 cm to about 8 cm.

In the holding sealing material according to the embodiments of the present invention, the average fiber diameter of inorganic fibers is desirably from about 1 μm to about 20 μm, and more desirably from about 3 μm to about 10 μm.

The amount of binder contained in the holding sealing material according to the embodiments of the present invention is desirably from about 0.2% by weight to about 15% by weight, more desirably from about 0.2% by weight to about 12% by weight, and further more desirably from about 0.2% by weight to about 2% by weight.

In a case where the amount of the binder is about 0.2% by weight or more, since the bulk density of the holding sealing material tends to be high, the press-fitting property of the holding sealing material into the casing base is more likely to be improved. On the other hand, in a case where the amount of the binder is about 15% by weight or less, the binder among inorganic fibers is less likely to interfere with the permeation of the corrosive agent into the holding sealing material by capillarity. As a result, the corrosive agent is more likely to be absorbed in the holding sealing material. Moreover, even when the intense heat is applied to the exhaust gas purifying apparatus in which the holding sealing material is used, the amount of organic components in exhaust gases to be discharged tends not to increase. As a result, a higher load is less likely to be applied to the environment.

Although not particularly limited, the weight per square meter of the holding sealing material according to the embodiments of the present invention is desirably from about 500 $g/m^2$ to about 5000 $g/m^2$, and more desirably from about 1000 $g/m^2$ to about 4000 $g/m^2$. Although not particularly limited, the bulk density thereof is desirably from about 0.10 $g/cm^3$ to about 0.30 $g/cm^3$.

Although not particularly limited, the thickness of the holding sealing material according to the embodiments of the present invention is desirably about 6 mm to about 20 mm.

The binder used for manufacturing the holding sealing material according to the embodiments of the present invention is not limited to the acrylic-based resin, and examples thereof include: rubbers such as acrylic rubber; water-soluble organic polymers such as carboxymethyl cellulose or polyvinyl alcohol; thermoplastic resins such as styrene resin; thermosetting resins such as epoxy resin; and the like. Particularly preferred among these are acrylic rubber, acrylonitrile-butadiene rubber, and styrene-butadiene rubber.

The emulsion may contain a plurality of the above binders.

Besides the latex in which the above-mentioned binder is dispersed in water, the emulsion may be a solution in which the above-mentioned binder is dissolved in water or an organic solvent.

The exhaust gas treating body in the exhaust gas purifying apparatus according to the embodiments of the present invention may be prepared as an integral exhaust gas treating body configured by one sintered body as a whole, as illustrated in FIG. 4, or may be prepared as an aggregated exhaust gas treating body obtained by using adhesive layers and combining a plurality of honeycomb fired bodies each having a structure in which a large number of cells are longitudinally disposed in parallel with one another, with a cell wall being interposed therebetween.

Catalyst may be supported on the exhaust gas treating body in the exhaust gas purifying apparatus according to the embodiments of the present invention. Examples of the catalyst include: noble metals such as platinum, palladium, and rhodium; alkali metals such as potassium and sodium; alkali earth metals such as barium; metal oxides; and the like. These catalysts can be used alone or in combination of two or more.

In addition, the metal oxide is not particularly limited as long as it can lower the burning temperature of PM, and examples thereof include $CeO_2$, $ZrO_2$, $FeO_2$, $Fe_2O_2$, CuO, $CuO_2$, $Mn_2O_2$, MnO, complex oxides indicated by a composition formula $A_nB_{1-n}CO_3$ (in the formula, A is La, Nd, Sm, Eu, Gd or Y; B is an alkali metal or alkali-earth metal; C is Mn, Co, Fe or Ni; and with n being set in the range of $0 \leqq n \leqq 1$), and the like.

Each of these catalysts may be used alone, or two or more kinds of these may be used in combination; however, the catalyst desirably contains at least $CeO_2$.

By supporting a metal oxide of this kind, the burning temperature of PM tends to be lowered.

Examples of the method for applying catalyst to the exhaust gas treating body include: a method in which the exhaust gas treating body is impregnated with a solution containing catalyst and then heated; a method for forming a catalyst supporting layer consisting of an alumina film on the surface of the exhaust gas treating body and applying catalyst to the alumina film; and the like.

Examples of the method for forming the alumina film include: a method in which the exhaust gas treating body is impregnated with a solution of a metal compound containing aluminum such as $Al(NO_3)_3$ and then heated; a method in which the exhaust gas treating body is impregnated with a solution containing alumina powder and then heated; and the like.

Examples of the method for applying catalyst to the alumina film include: a method in which the exhaust gas treating body is impregnated with a solution containing a noble metal, an alkaline metal, an alkaline earth metal, or a metal oxide, and the like, and then heated; and the like.

What is claimed as new and is desired to be secured by Letters Patent of the United States is:

1. An exhaust gas purifying apparatus comprising:

an exhaust gas treating body having a longitudinal direction and comprising:

cell walls extending along the longitudinal direction to define cells between the cells;

a metal casing having an inner surface and housing said exhaust gas treating body to face the inner surface;

a holding sealing material provided between said exhaust gas treating body and the inner surface of said metal casing to hold said exhaust gas treating body in the metal casing, the holding sealing material including an inorganic fiber aggregated body; and said metal casing having a corrosion area at least on a part of the inner surface, the corrosion area comprising a corroded base material of said metal casing;

wherein the corrosion area comprises corrosion products which are complicatedly hooked to inorganic fibers forming the holding sealing material;

wherein the corrosion products are formed by a corrosive agent which is introduced into the end portion of the holding sealing material;

wherein the corrosive agent comprises at least one of an acid solution, an oxidant solution, and a chloride solution;

wherein an acid in the acid solution comprises at least one of hydrochloric acid, nitric acid, sulfuric acid, phosphoric acid, hydrofluoric acid, sulfonic acid, acetic acid, formic acid, carbonic acid, and boric acid;

wherein an oxidant in the oxidant solution comprises at least one of peroxy acid, hydrogen peroxide, permanganic acid, perchloric acid, hypochlorous acid, and their salts; and wherein a chloride in the chloride solution comprises at least one of chlorides of lithium, sodium, potassium, rubidium, caesium, beryllium, magnesium, calcium, strontium, barium, and radium.

2. The exhaust gas purifying apparatus according to claim 1, wherein the corrosion area covers a substantially entire inner circumference of the inner surface and is in a range from about 10% to about 70% of a total length of the inner surface from one end to an other end in a longitudinal direction of said metal casing.

3. The exhaust gas purifying apparatus according to claim 1, wherein the corrosion area covers a part of an inner circumference of the inner surface.

4. The exhaust gas purifying apparatus according to claim 3, wherein the corrosion area covers an area of about 25% or more and less than about 100% of the inner circumference.

5. The exhaust gas purifying apparatus according to claim 1, wherein said metal casing comprises at least one of a stainless steel and a cast iron.

6. The exhaust gas purifying apparatus according to claim 5, wherein the stainless steel comprises at least one of a martensitic stainless steel, a ferritic stainless steel, and an austenitic stainless steel.

7. The exhaust gas purifying apparatus according to claim 5, wherein the cast iron comprises at least one of a common cast iron, a high-grade cast iron, a special cast iron, and a malleable cast iron.

8. The exhaust gas purifying apparatus according to claim 1, wherein the corrosion area includes a corrosion product and the corrosion product has at least one of a projected shape, a recessed shape, a burr shape, a substantially spike-mound shape, a zigzag shape, a hook shape, and a flake shape, the flake shape being formed by a partial detachment of the part of the inner surface.

9. The exhaust gas purifying apparatus according to claim 1, wherein the corrosion area includes a corrosion product and the corrosion product is disposed randomly or formed in a random direction.

10. The exhaust gas purifying apparatus according to claim 1, wherein inorganic fibers forming said holding sealing material comprise at least one of alumina fibers, ceramic fibers, and silica fibers.

11. The exhaust gas purifying apparatus according to claim 1, wherein said holding sealing material comprises a needle mat obtainable by needling a base mat including inorganic fibers.

12. The exhaust gas purifying apparatus according to claim 1, wherein inorganic fibers forming said holding sealing material has an average fiber length of from about 0.5 cm to about 10 cm.

13. The exhaust gas purifying apparatus according to claim 1, wherein inorganic fibers forming said holding sealing material has an average fiber diameter of from about 1 μm to about 20 μm.

14. The exhaust gas purifying apparatus according to claim 1, wherein said holding sealing material further comprises a binder and an amount of the binder is from about 0.2% by weight to about 15% by weight.

15. The exhaust gas purifying apparatus according to claim 1, wherein said exhaust gas treating body comprises a porous ceramic.

16. The exhaust gas purifying apparatus according to claim 1, wherein a catalyst is supported on said exhaust gas treating body.

17. The exhaust gas purifying apparatus according to claim 16, wherein the catalyst comprises at least one of platinum, palladium, rhodium, potassium, sodium, barium, and a metal oxide.

* * * * *